US009309681B2

(12) United States Patent
Morley

(10) Patent No.: US 9,309,681 B2
(45) Date of Patent: Apr. 12, 2016

(54) TOOL FOR SHAPING SEALANT

(71) Applicant: Roger Morley, Surrey (GB)

(72) Inventor: Roger Morley, Surrey (GB)

(73) Assignee: Roger Morley, Surrey (GB)

( * ) Notice: Subject to any disclaimer, the term of this patent is extended or adjusted under 35 U.S.C. 154(b) by 0 days.

(21) Appl. No.: 14/437,962

(22) PCT Filed: Oct. 23, 2013

(86) PCT No.: PCT/GB2013/052764
§ 371 (c)(1),
(2) Date: Apr. 23, 2015

(87) PCT Pub. No.: WO2014/064441
PCT Pub. Date: May 1, 2014

(65) Prior Publication Data

US 2015/0275529 A1 Oct. 1, 2015

(30) Foreign Application Priority Data

Oct. 23, 2012 (GB) ..... 1219035.1

(51) Int. Cl.
*E04F 21/165* (2006.01)
*B26D 3/08* (2006.01)

(52) U.S. Cl.
CPC ..... *E04F 21/1652* (2013.01); *B26D 3/08* (2013.01); *E04F 21/1655* (2013.01); *Y10T 83/0341* (2015.04)

(58) Field of Classification Search
CPC ..... E04F 21/1652; E04F 21/1655; B26D 3/08
See application file for complete search history.

(56) References Cited

U.S. PATENT DOCUMENTS 5,664,280 A 9/1997 Tonsager
5,938,094 A * 8/1999 Forhan et al. ..... 224/560

FOREIGN PATENT DOCUMENTS

DE 202010003057 U1 * 7/2010
GB 2290102 A 12/1995
WO WO 2007133096 A2 11/2007

OTHER PUBLICATIONS

International Search Report completed for PCT/GB2013/052764 on Mar. 21, 2014 within the European Patent Office.

* cited by examiner

*Primary Examiner* — Shay Karls
(74) *Attorney, Agent, or Firm* — Leydig, Voit & Mayer, LTD

(57) ABSTRACT

A tool 1 for shaping sealant disposed in a corner between two surfaces. The tool 1 has a body 3 which has an edge 9 for smoothing sealant, and two wings 5, 7, one on each of two opposite sides of the body 3. The wings 5, 7 may be arranged to extend through a range of angles from the body 3. The wings 5, 7 may be hingedly connected to the body 3.

15 Claims, 12 Drawing Sheets

TOOL FOR SHAPING SEALANT

TECHNICAL FIELD OF THE INVENTION

The present invention relates to a tool for shaping sealant.

BACKGROUND TO THE INVENTION

Sealant is often used in building work when it is necessary to close joints and gaps between masonry, tile, timber and other materials. This is particularly the case where it is desirable to make a gap or joint substantially water impermeable such as the gap between a bath and an adjacent, tiled wall. Traditionally, sealant or caulk is applied as a bead along a gap or joint using a caulking gun which usually comprises a cylindrical chamber for containing the sealant, a nozzle from which the sealant may be dispensed from the chamber and a plunger for forcing the sealant in the chamber out through the nozzle.

A problem many caulking guns is that the sealant is not always dispensed in a uniform manner and this can lead to an unsightly, irregular bead of sealant being applied that either does not entirely fill the joint or that spills over and around the joint, thereby creating mess. Caulking guns are also not very effective at urging the bead of sealant into the joint to create a neat finish which means that the user must often resort to using a finger to shape the bead and smooth it out. Not only is this procedure messy but even when using a finger, the applied sealant can still be unsightly with non-uniform edges.

It is an object of the present invention to mitigate the above difficulties.

SUMMARY OF THE INVENTION

According to an aspect of the present invention, there is provided a tool for shaping sealant disposed in a corner between two surfaces, the tool comprising a body having an edge for smoothing sealant, and two wings, one on each of two opposite sides of the body.

Advantageously, the wings help to contain the sealant and focus the sealant at the tip which helps to prevent the sealant from spilling from the sides of the body. Thus a sealing tool according to the invention is capable of producing a uniform, smooth line of sealant via the tip whilst minimising any mess. The wings also help to position the tool between two interfacing surfaces so that the tip is maintained in a fairly constant position when travelling along the corner.

The wings may be arrangeable to extend away from the body through a range of angles. The wings may be hingedly connected to the body. The wings may be arranged to extend toward one another. The wings may be arranged relative to the body to define a space in which sealant may collect.

The body may comprise a sheet of material. The wings may comprise the same sheet of material as the body. The wings may be arranged to extend substantially parallel to the body.

The wings may each have a tapered edge that tapers toward the smoothing edge. The smoothing edge may be substantially flat. The smoothing edge may be substantially convex. The smoothing edge may be substantially concave. The body may be substantially triangular in shape.

According to another aspect of the present invention, there is provided a method of manufacturing a tool according to the first aspect, comprising the steps of:

providing a sheet of material of a predetermined shape; and scoring the material to form two hinges that converge toward an edge of the shape.

DETAILED DESCRIPTION OF THE INVENTION

In order that the invention may be more clearly understood embodiments thereof will now be described, by way of example only, with reference to the accompanying drawings, of which:

FIG. 1 is a plan view of a tool according to the invention when flattened out;

FIG. 1*a* is an enlarged view of a leading edge of the tool shown in FIG. 1;

Figure 10B:
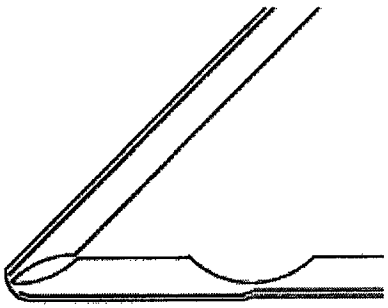
Figure 10A:
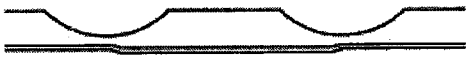
Figure 11:
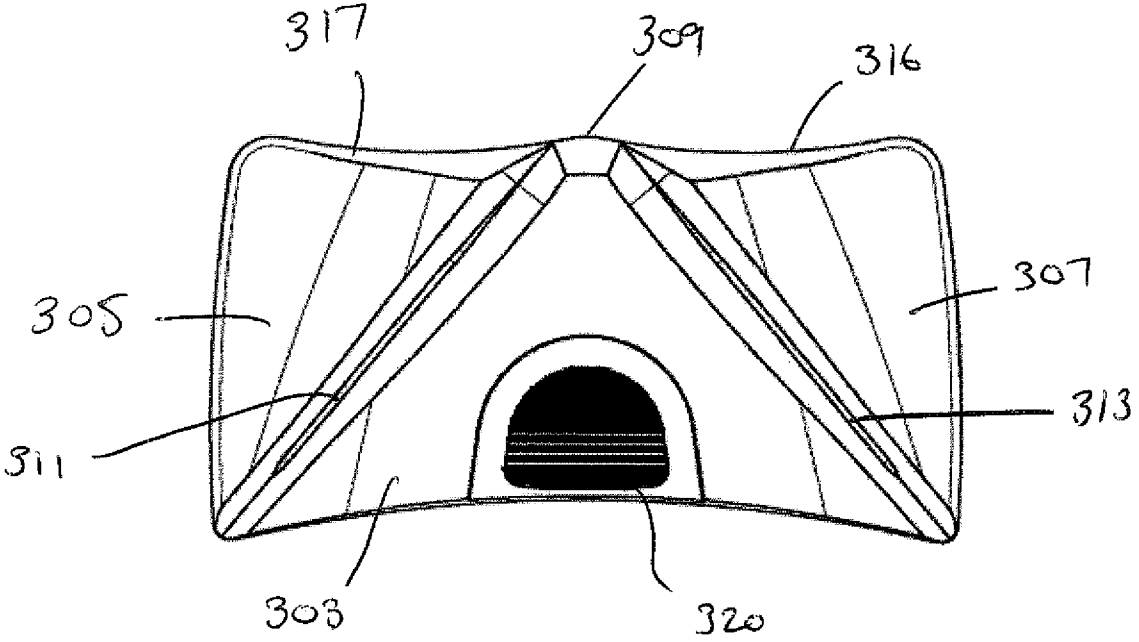
Figure 12:
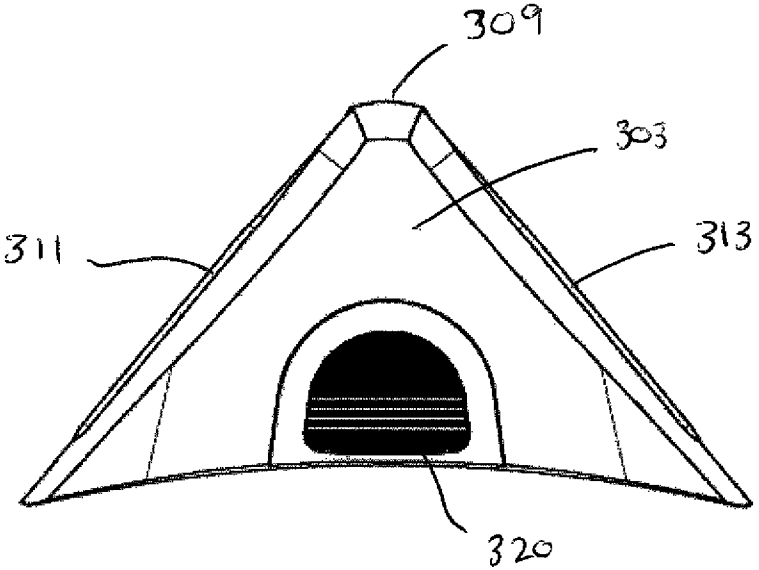
Figure 13:
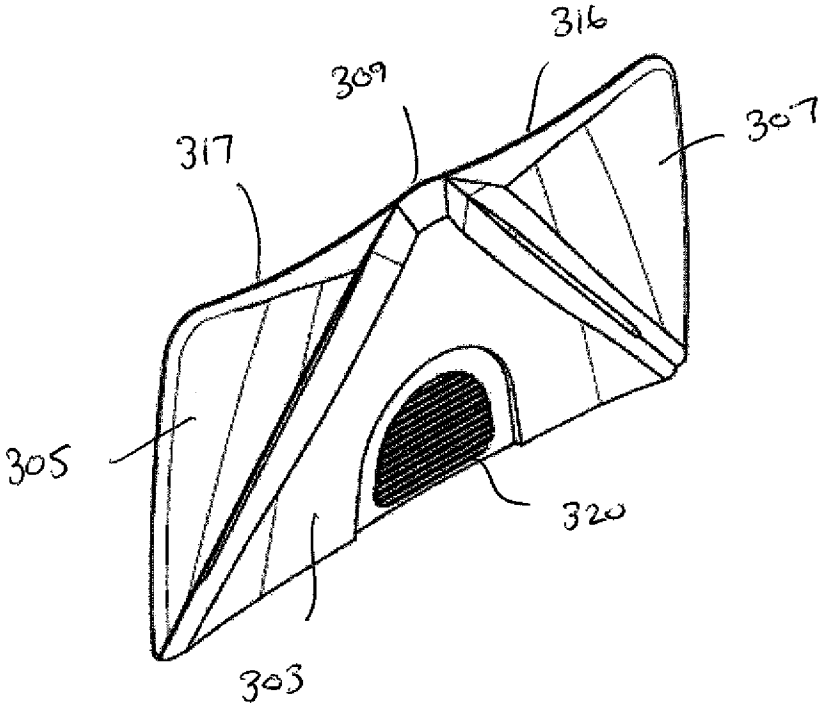
Figure 14:
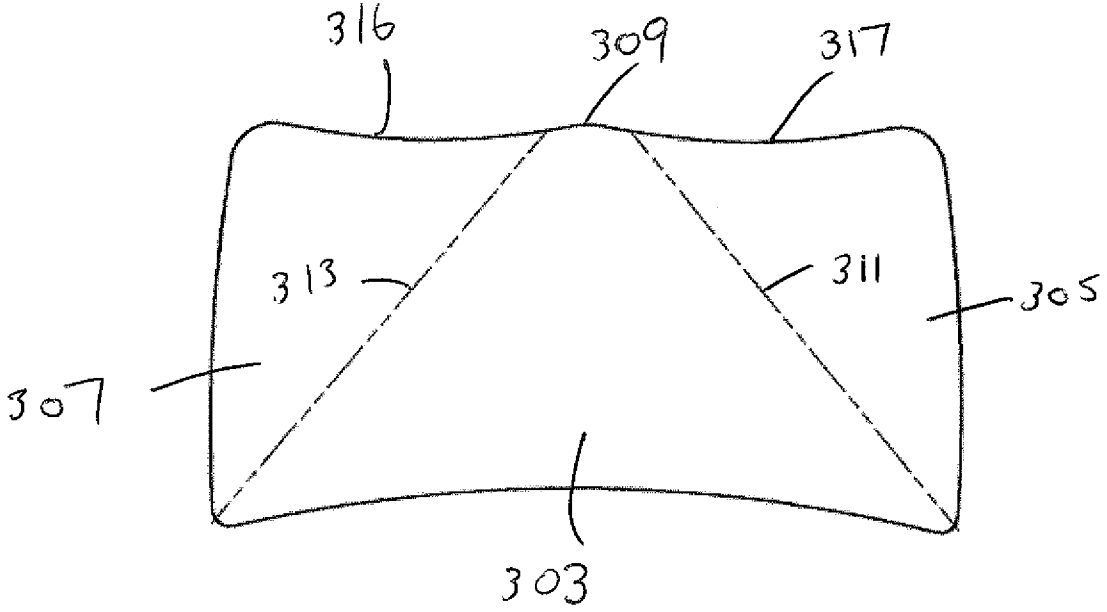
Figure 15:
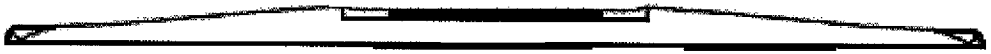

FIG. 10*a* shows an enlarged view of the hinges between the body of the tool and the wings;

FIG. 10*b* shows the hinges of FIG. 10*a* when the body and a wing are hinged toward one another;

FIG. 11 shows a plan view of an alternatively shaped tool according to the invention;

FIG. 12 shows a plan view of the tool shown in FIG. 11 when the two wings are folded inwardly;

FIG. 13 shows a perspective view of the tool shown in FIG. 11;

FIG. 14 shows a plan view the underside of the tool shown in FIG. 11; and FIG. 15 shows a side view of the tool shown in FIG. 11.

With reference to the drawings, there is shown a sealing tool 1 made from polypropylene plastics material comprising a substantially flat, triangular sheet forming a body 3 and a pair of wings 5, 7 that are hingedly attached to opposite sides respectively of the body 3. The wings 5, 7 are tapered and arranged such that they converge toward one corner of the body 3 which has an edge 9 for smoothing sealant. In this embodiment, the smoothing edge 9 has a substantially flat edge to aid in the application of a bead of sealant of substantially uniform width having a substantially flat surface.

The wings 5, 7 each have three sides (including the side which is attached to the body 3). The free side 16, 17 or leading edge of each wing 5, 7 that converges toward the tip 9 is curved to help urge the sealant toward the tip 9. The two leading edges 16, 17 are tapered like the edge of a blade to assist in the removal of unwanted sealant when the tool is passed over a bead of sealant. The body 3 part and wing parts 5, 7 are formed by taking a blank of appropriately shaped polypropylene plastic and cutting two converging grooves across the blank from one side to another to form hinges between the body 3 and the wings 5, 7. The grooves may be concave to encourage movement of the wings 5, 7 relative to the body in a particular direction as shown in FIGS. 10*a* and 10*b*. The depth of the grooves is chosen to create tension between the body 3 and the wings 5, 7 so that, in use, pressure is applied and maintained against the smoothing edge 9 and leading edges 16, 17, thereby ensuring effective shaping of the bead and removal of residual sealant.

The wings 5, 7 can be arranged to be substantially coplanar with the body 3 or to extend from the body 3 through a range of angles from zero degrees up to 180 degrees. Thus, the body 3 and wings 5, 7 can be arranged to be substantially flat so that the space occupied by the sealing tool 1 can be kept to a minimum for transportation, storage and packing. The ability to flatten the tool 1 also makes it easier to clean. Both wings 5, 7 hinge in the same direction away from the body and therefore may be closed in toward one another to define a space between the body 3 and the wings 5, 7 in which sealant may collect.

Figure 2:
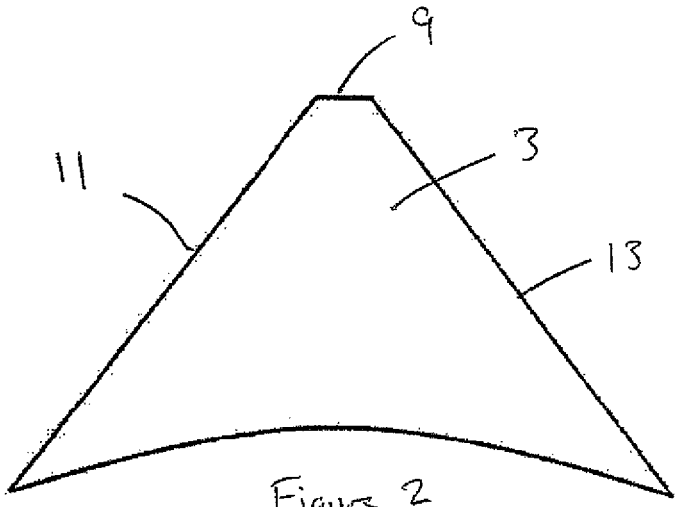
FIG. 2 is a plan view of the body of the tool shown in FIG. 1.
Figure 1:
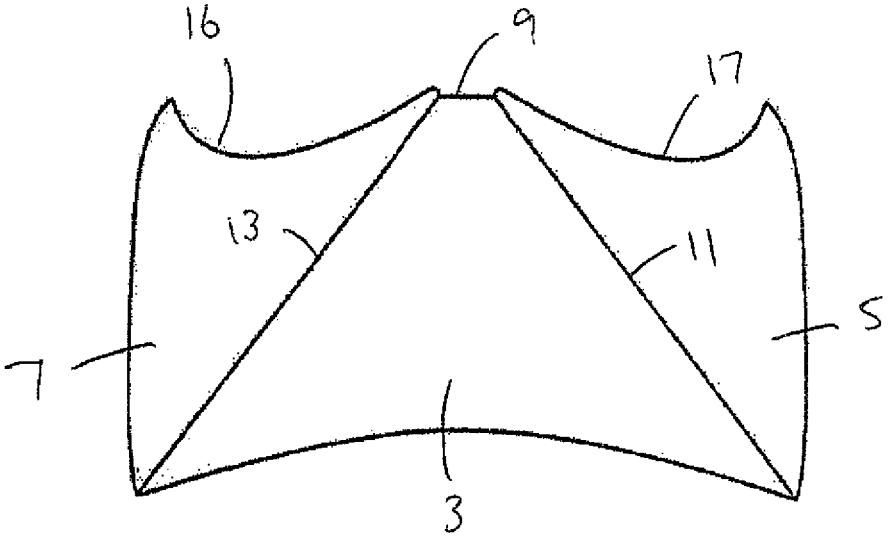
Figure 1A:
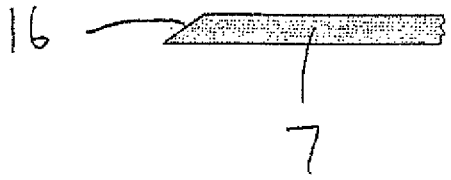
Figure 5:
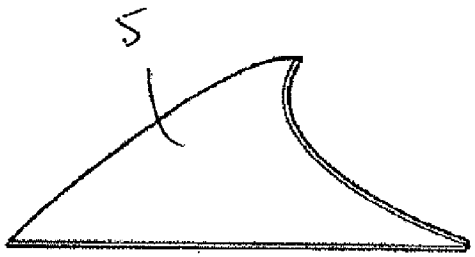
FIG. 5 is a right side view of the tool shown in FIG. 3.
Figure 3:
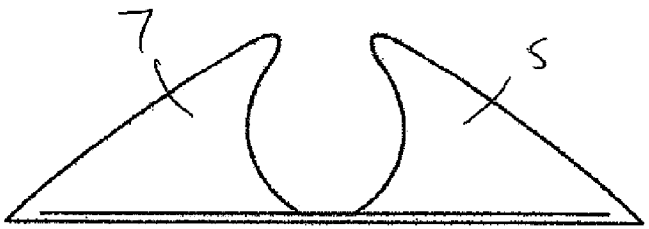
FIG. 3 is a rear view of the tool shown in FIG. 1 when the two wings are arranged at an angle relative to the body.
Figure 4:
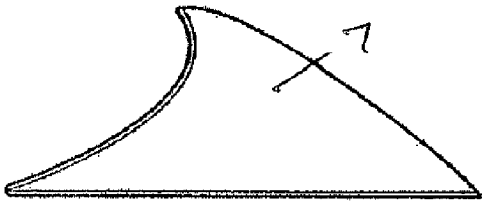
FIG. 4 is a left side view of the tool shown in FIG. 3.
Figure 6:
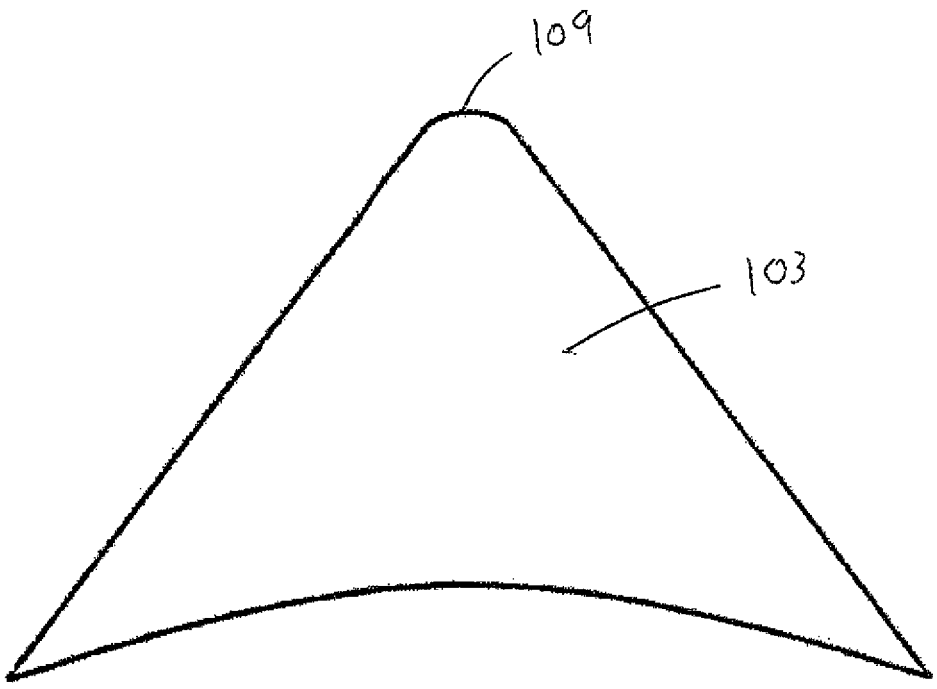
FIG. 6 is a plan view of an alternatively shaped body of a tool according to the invention.
Figure 7:
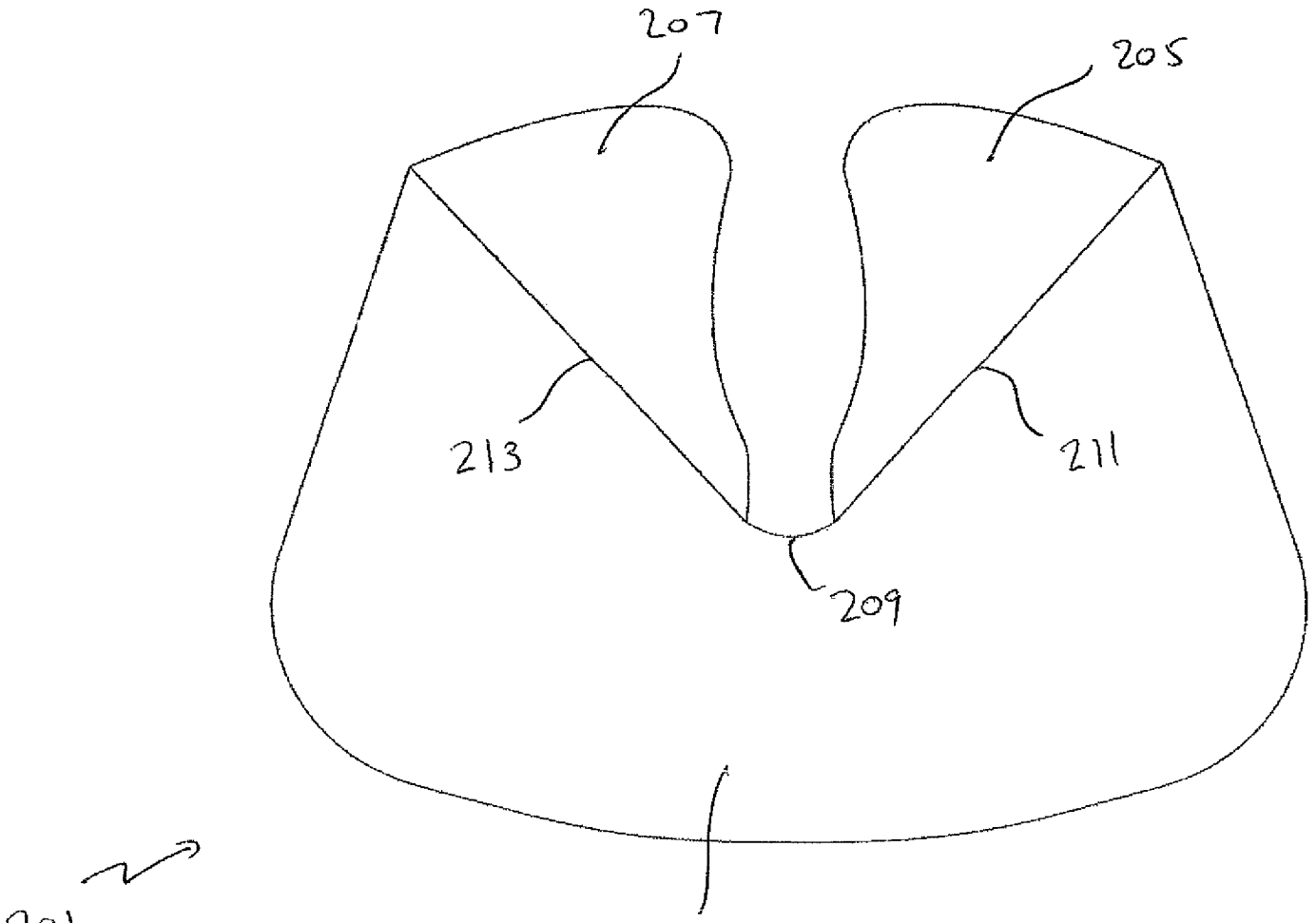
FIG. 7 is a plan view of an alternatively shaped body of a tool according to the invention.
Figure 8:
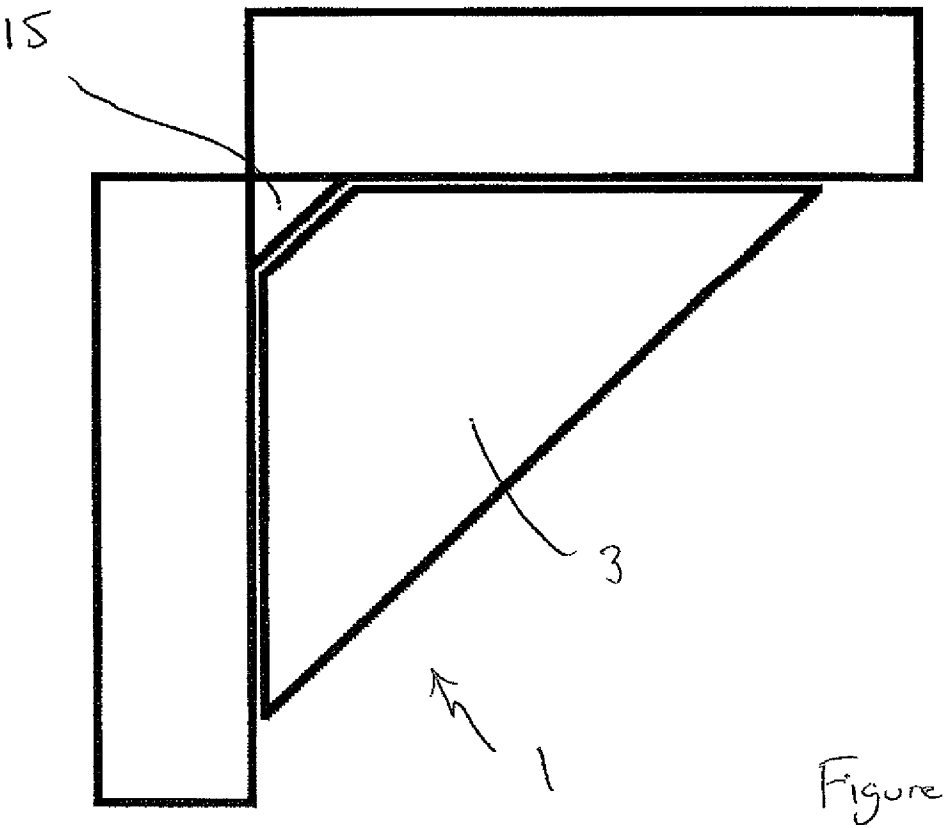
FIG. 8 shows the tool shown in FIG. 1 in use.
Figure 9:
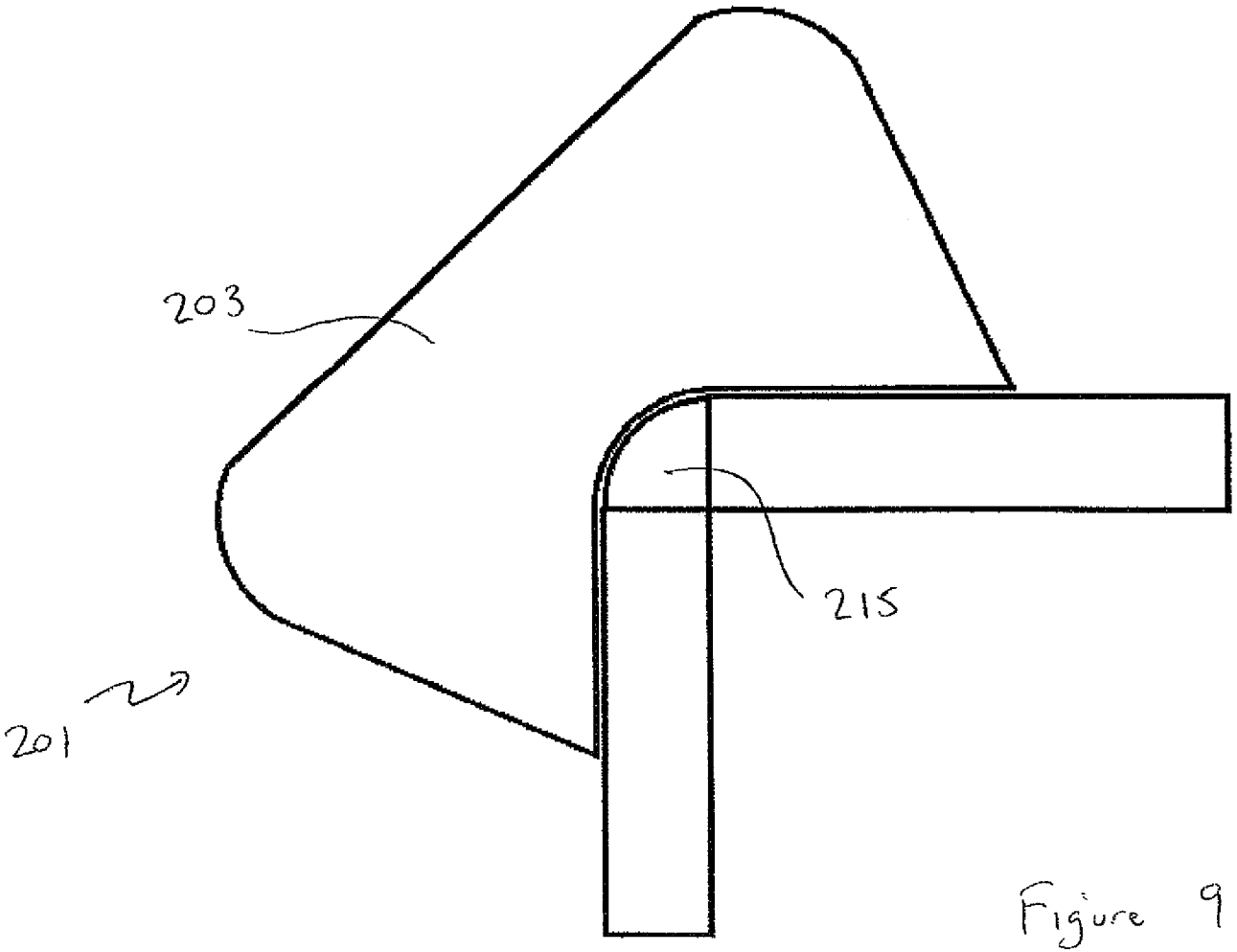
FIG. 9 shows the tool shown in FIG. 7 in use.

The two edges 11, 13 of the body to which the wings 5, 7 are attached are substantially perpendicular to one another to enable the edges of the sealing tool 1 to be seated against adjacent substantially perpendicular walls whose interface or corner is the region at which sealant is intended to be applied. In this embodiment, the body 3 is arranged to lie within an internal corner. Alternatively, as shown in FIGS. 7 and 9, the body 203 is arranged to extend around an external corner whose surfaces are separated by approximately 270 degrees. This is useful where it is intended to apply sealant to an external curve of a plastered wall. The wings 5, 7, 205, 207—may be arranged to extend substantially perpendicularly from the body 3, 203 so that the wings 5, 7, 205, 207 can extend substantially parallel to and bear against the respective interfacing walls. This helps to guide the sealing tool 1, 201 along the interface and enables the smoothing edge 9, 209 to be maintained at a substantially fixed distance from the corner so that a bead of sealant of substantially uniform cross-section can be achieved.

In use, sealant 15 is applied using a caulking gun along an interface between two adjacent, substantially perpendicular surfaces. When sufficient sealant has been applied, the sealing tool 1 is arranged so that the wings 5, 7 extend substantially perpendicularly to the body. The tool 1 is then urged into the corner such that the smoothing edge 9 is inserted into the bead of sealant. When the edges 11, 13 of the body 3 abut the adjacent interfacing surfaces and the wings 5, 7 bear against the corresponding surface, the smoothing edge is held a distance from the interface or corner. The tool 1 is then drawn along the interface in a direction in which the wings 5, 7 extend. Movement of the tool along the interface causes excess sealant to be caught by the smoothing edge 9 and wings 5, 7 thereby leaving behind a smooth bead of sealant of substantially uniform thickness and width.

In an alternative embodiment, the smoothing edge 109 is substantially convex so that, when the smoothing edge 109 is inserted into the bead and drawn along the interface, a substantially concave surface is obtained which bows in toward the interface. In the case of the outer corner tool 201, the smoothing edge 209 is arranged to be concave so as to produce a convex shaped bead of sealant 215. Thus, different bead finishes can be obtained by altering the shape of the smoothing edge.

In a further alternative embodiment as shown in FIGS. 11 to 15, the tool comprises a thumb grip 320 on the side of the body 303 that faces away from the caulking area when in use. The grip 320 is conveniently placed toward the edge of the body 303 opposite the smoothing edge 309 so that, in use, the tool can be firmly gripped and held against two interfacing walls. Since the ability of the user to grasp the tool firmly is improved, the tool can be held more stably which permits the application of a smooth, uniform bead of sealant. The thumb grip 320 comprises a number of small ridges to enhance the friction between the user's thumb and the tool.

The above embodiments are described by way of example only. Many variations are possible without departing from the scope of the invention as defined in the appended claims. For example, the wings 5, 7 can be of different sizes so that the tool can be used for alternative applications. The tool itself canals be varied in size according to its application. For example, a larger tool may be required where it is desired to smooth plaster instead of sealant. The tool could also be arranged with the wings at angles that are fixed relative to the body so that the tool is pre-set at a position that enables the application of a smooth, uniform bead of sealant.

The invention claimed is:

1. A tool for shaping sealant disposed in a corner between two surfaces, the tool comprising a body having an edge for smoothing sealant, and two wings, one on each of two opposite sides of the body, wherein the wings are hingedly connected to the body at respective edges of the body that are substantially perpendicular to one another.

2. A tool as claimed in claim 1, wherein the wings are arrangeable to extend away from the body through a range of angles.

3. A tool as claimed in claim 2, wherein the body is substantially flat and the wings are arrangeable to extend substantially perpendicular to the body and to extend substantially parallel to respective perpendicular surfaces that define the corner in which the sealant to be shaped is disposed.

4. A tool as claimed in claim 2 wherein the wings are arrangeable to extend toward one another.

5. A tool as claimed in claim 2 wherein the wings are arrangeable relative to the body to define a space in which sealant may collect.

6. A tool as claimed in claim 1, wherein the body comprises a sheet of material.

7. A tool as claimed in claim 6, wherein the wings comprise the same sheet of material as the body.

8. A tool as claimed in claim 6, wherein the wings are arrangeable to extend substantially parallel to the body.

9. A tool as claimed in claim 1, wherein the wings each have a tapered free edge, the tapered edges converging that tapers toward the smoothing edge.

10. A tool as claimed in claim 9, wherein the tapered free edges are curved.

11. A tool as claimed in any preceding claim 1, wherein the smoothing edge is substantially flat.

12. A tool as claimed in claim 1 wherein the smoothing edge is substantially convex.

13. A tool as claimed in claim 1, further comprising a formation having a profile that enhances the friction between the tool and an appendage of a user of the tool.

14. A tool as claimed in claim 13, wherein the profile comprises one or more ridges.

15. A method of manufacturing a tool according to claim 1, comprising the steps of:

providing a sheet of material of a predetermined shape; and scoring the material to form two substantially perpendicular hinges that converge toward an edge of the shape.

* * * * *